US007980610B2

(12) United States Patent
Claraz et al.

(10) Patent No.: US 7,980,610 B2
(45) Date of Patent: Jul. 19, 2011

(54) DEVICE FOR SLINGING A PIECE WITH STRESS COMPENSATION AND HOISTING SYSTEM CONTAINING THIS DEVICE

(75) Inventors: Pascal Claraz, Lapeyrouse Fossat (FR); Jean-Marc Datas, Toulouse (FR)

(73) Assignee: Airbus France, Toulouse (FR)

( * ) Notice: Subject to any disclaimer, the term of this patent is extended or adjusted under 35 U.S.C. 154(b) by 657 days.

(21) Appl. No.: 11/914,081

(22) PCT Filed: Apr. 27, 2006

(86) PCT No.: PCT/FR2006/050394

§ 371 (c)(1),
(2), (4) Date: Jun. 30, 2008

(87) PCT Pub. No.: WO2006/120363

PCT Pub. Date: Nov. 16, 2006

(65) Prior Publication Data

US 2009/0026780 A1 Jan. 29, 2009

(30) Foreign Application Priority Data

May 12, 2005 (FR) ..... 05 51237

(51) Int. Cl.
*B66C 1/12* (2006.01)

(52) U.S. Cl. ..... 294/82.16; 294/74

(58) Field of Classification Search ..... 294/74, 294/82.15, 82.16, 86.41; 414/139.6; 254/277
See application file for complete search history.

(56) References Cited

U.S. PATENT DOCUMENTS

| | | | | | |
|---|---|---|---|---|---|
| 1,803,721 | A | * | 5/1931 | Minor | 267/70 |
| 2,283,354 | A | * | 5/1942 | Dalzell | 116/68 |
| 2,500,459 | A | * | 3/1950 | Hoover et al. | 267/127 |
| 2,860,908 | A | * | 11/1958 | Peterson | 294/82.15 |
| 3,512,657 | A | * | 5/1970 | Chambers | 414/138.3 |
| 3,792,787 | A | | 2/1974 | Maloney | |
| 4,121,806 | A | | 10/1978 | Iato et al. | |
| 4,724,970 | A | * | 2/1988 | Kuhn | 212/272 |
| 4,930,828 | A | * | 6/1990 | Rerat | 294/82.15 |

FOREIGN PATENT DOCUMENTS

| | | | |
|---|---|---|---|
| FR | 2814449 | A | 3/2002 |
| JP | 2002167161 | A | 6/2002 |

OTHER PUBLICATIONS

Patent Abstracts of Japan, vol. 2002, No. 10, Oct. 10, 2002.

* cited by examiner

*Primary Examiner* — Dean J Kramer
(74) *Attorney, Agent, or Firm* — Perman & Green, LLP

(57) ABSTRACT

A slinging device for a piece includes a sling with a nonextensible part and a section with a spring device, enabling an elastic lengthening or shortening of the sling under load by a limited amplitude in response to a limited change in the load on the piece, the device including a frame and a floating support, the spring device holding the floating support in the absence of application of force to the piece along a vertical axis, in a position of equilibrium centered vertically with respect to the frame under the weight of the piece, and a way for regulating and adapting the position of equilibrium of the floating support depending on the weight of the piece.

20 Claims, 5 Drawing Sheets

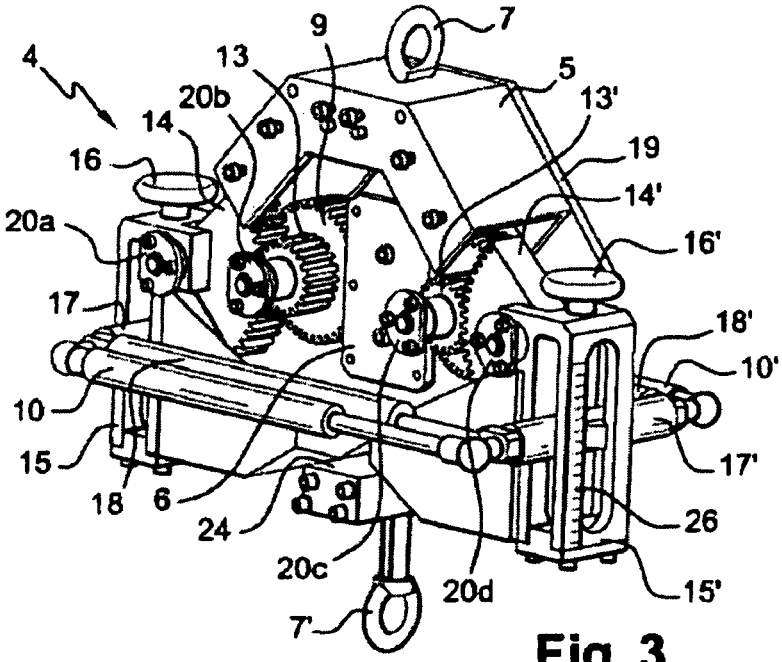
Fig. 3
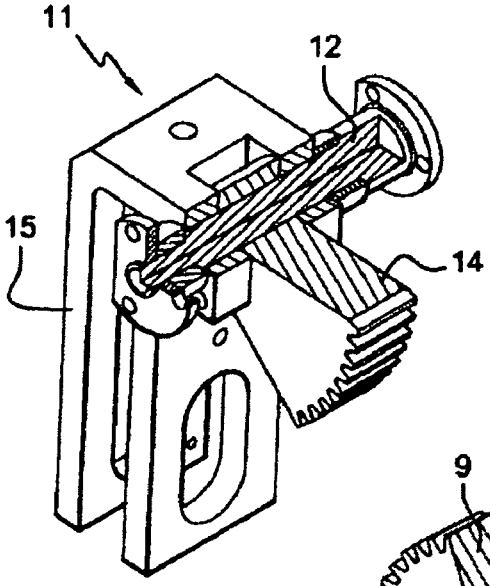
Fig. 4
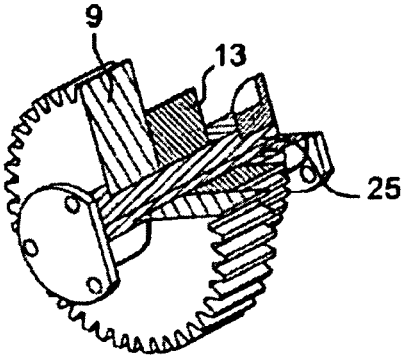
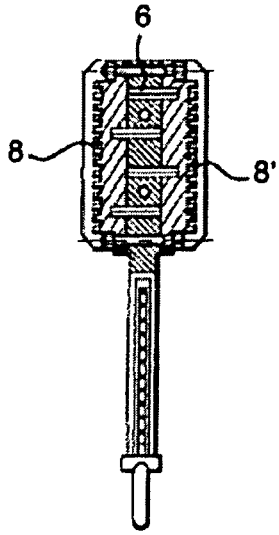

DEVICE FOR SLINGING A PIECE WITH STRESS COMPENSATION AND HOISTING SYSTEM CONTAINING THIS DEVICE

CROSS-REFERENCE TO RELATED APPLICATIONS

This application is the National Stage of International Application No. PCT/FR2006/050394 International Filing Date, 27 Apr. 2006, which designated the United States of America, and which International Application was published under PCT Article 21 (s) as WO Publication No. WO2006/120363 A1 and which claims priority from, and the benefit of, French Application No. 05 51237 filed on 12 May 2005, the disclosures of which are incorporated herein by reference in their entireties.

The disclosed embodiments concern a device for slinging a piece with stress compensation, particularly adapted to be used with a hoisting system such as a travelling crane or a gantry crane supporting slung pieces, as well as a hoisting system containing this device.

BACKGROUND

In the context of the positioning of heavy elements such as structural elements of a device being assembled, it is common to use travelling cranes as the hoisting systems, suspended from structures of an assembly shed, or fixed or mobile cranes.

Such hoisting systems are designed to handle elements often weighing between a hundred kilos and several dozen tons, borne by a sling, and offering a great precision of positioning along a vertical axis and a horizontal plane, such as is customary in the assembly of elements of buildings, of ships, of aircraft or other apparatus such as electrical generators.

They are used as working machines to obtain a positioning precision less than a millimeter, or on the order of 1/10 of a mm, so as to be able to connect elements in very precise manner without causing stresses or damage to the structures being connected.

A first difficulty in maintaining the precision of positioning along the vertical axis comes from the fact that the systems or means of hoisting, because of their weight and the weight which they are lifting, carrying and moving, produce a stress on the support structures, liable to generate displacements of these structures or their foundation.

When a single hoisting means is used, the displacements of the support structures under the action of its own movements are of no inconvenience, but when several hoisting means are joined to the same support structure the displacement or the loading of one of the hoisting means may cause a change in positioning of another hoisting means. Measurements performed on complexes of two travelling cranes have found induced movements as much as several millimeters, that is, speed on the order of 0.25 mm/s.

In the case when the displacement of a first hoisting means such as a bridge occurs during an assembly operation, on a fixed element, of an element carried by a second bridge, the changes in height of the second bridge due to the displacement of the first bridge are detrimental to the precise connection of said elements during the course of the assembly.

Another difficulty, independent of the number of hoisting means, is that said means or the structures to which they are fixed are vulnerable to the wind.

In fact, wind causes stresses in the support structures of assembly sheds, for example, assembly sheds of large aircraft, which induce bending in said support structures, causing vertical displacements of the winches, possibly as much as several centimeters.

The combination of the effects of the wind and the effects due to interference between hoisting means can cause major damage to the elements in process of assembly, if it results in a vertical displacement of one element being carried relative to a structure resting on the ground, on which it is being mounted.

For example, a lifting on the order of 50 mm of one element being assembled onto a fixed element can cause a breaking of the sling, if the element being assembled is already at least partially fixed to the fixed element, or very substantial damage to the element being carried or to the fixed element.

One known solution involves the use of a dynamic system to control the position of the travelling cranes as a function of displacements of the support structure and to operate the winches of the hoisting means as a consequence of this.

Such a solution is not satisfactory, due to the complexity of the system being implemented: control units, sensors, position control means, furthermore requiring large instantaneous electric power for their operation.

SUMMARY

The disclosed embodiments start from a different principle, namely, to limit the dynamic stresses at the level of the link between the winch and a piece being mounted and to compensate, for this purpose, the stresses applied to the suspended piece by lengthening or shortening the sling between the winch and the piece by the mere fact of the dynamic stresses on the piece in the course of assembly.

To do so, the disclosed embodiments involve primarily a slinging device for a piece, wherein it comprises a sling provided with a nonextensible part and a section equipped with spring means, enabling an elastic lengthening or shortening of the sling under load by a certain limited amplitude in response to a particular limited change in the load on the piece.

Thus, according to the device of the disclosed embodiments, a movement of the support structure downward along the vertical axis having a tendency to lower the piece will be compensated by a reduction in the distance from the piece to the winch, if the piece should abut against an element fixed relative to the ground, and this in a predetermined range, so that the stress which the piece applies to the fixed element is kept below a limit value small enough to not cause damage to the piece being handled, to the fixed element, or to any other element connected to the piece or to the fixed element or arranged between the piece and the fixed element.

Likewise, a movement of the support structure upward along the vertical axis having a tendency to raise the piece will be compensated by a shortening of the distance from the piece to the winch, in a predefined range, if the piece is totally or partly assembled onto an element fixed in relation to the ground, so that the stress which the piece applies to the fixed element and to the assemblies is kept below the limit value, so as to avoid any similar damage.

The disclosed embodiments, which comprise load compensating means that modify the distance between the piece and the winch in response to a force applied to the piece along the vertical axis, enables a regaining of the positioning of the piece suspended from a winch by a suspension cable along the vertical axis.

Advantageously, the device comprises means for regulating the amplitude of the lengthening or shortening of the sling as a function of the load (F1, F2). These means, in particular, allow the device to be adapted to the pieces of different weight being handled.

More particularly, the spring means are part of a load compensating device, modifying the distance between the piece and a winch to which the sling is connected in response to a force applied to the piece along the vertical axis of the sling, comprised of a frame, a floating support, and said spring means to hold the floating support, in the absence of application of force to the piece along the vertical axis, in a position of equilibrium centered vertically with respect to the frame under the weight of the piece.

BRIEF DESCRIPTION OF THE DRAWINGS

Other characteristics and advantages of the disclosed embodiments will be better understood upon reading the following description of a nonlimiting sample embodiment in reference to the figures, which show:

FIG. 3: a side perspective view of a sample embodiment of a load compensating device according to the embodiment;

FIG. 4: sectional perspective detail views of elements of the device of FIG. 3;

DETAILED DESCRIPTION

Figure 1:
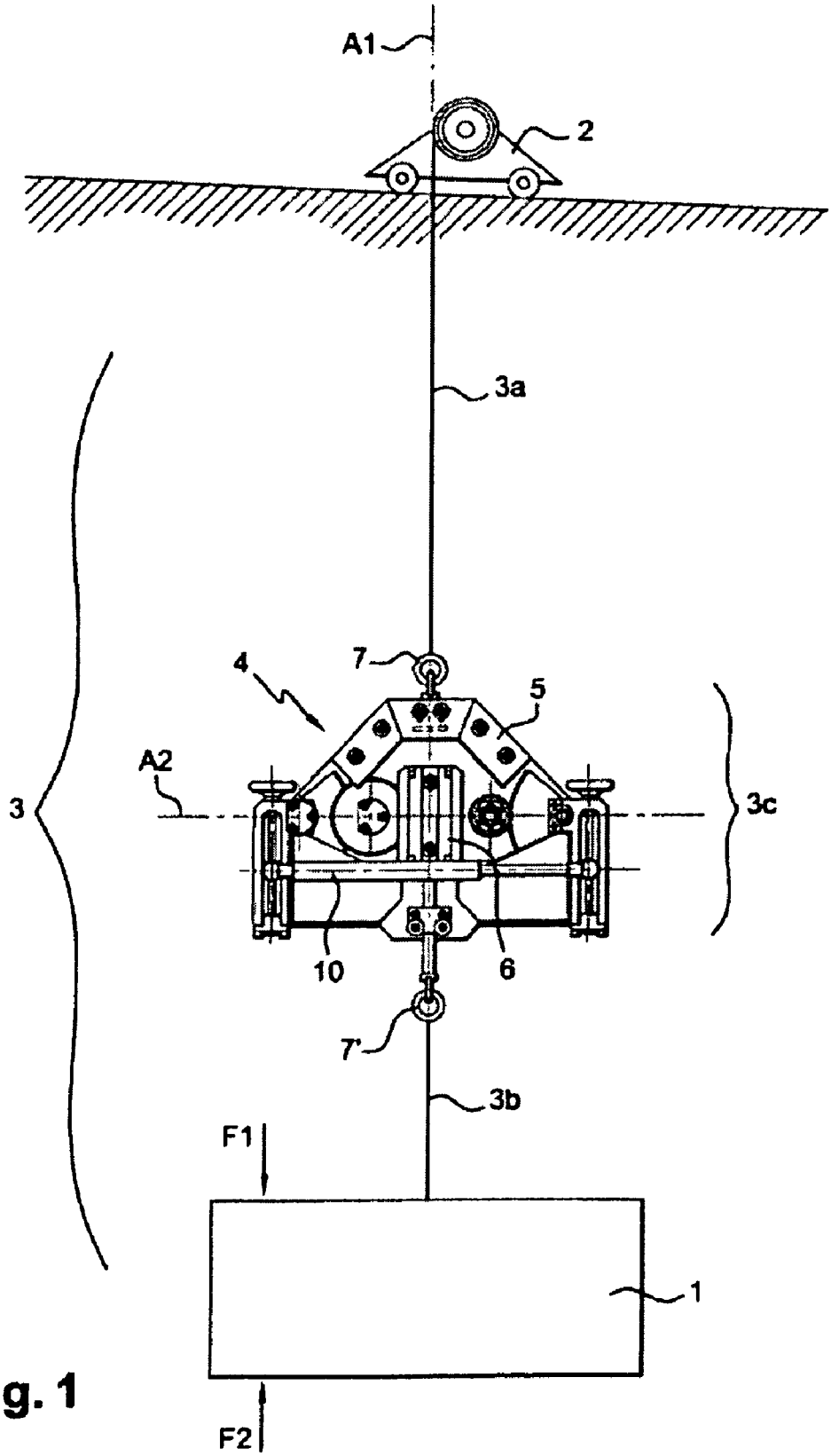
FIG. 1: a side view of a slinging device according to the embodiment.

The slinging device according to FIG. 1 comprises a winch 2, moving along a rail and supporting a piece 1, held by a sling 3.

The winch moves on the rail according to a control device, which is not shown, since it is traditional. Likewise, the sling can be shortened or lengthened by the winch so as to position the supported piece opposite a structure on the ground, on which it is supposed to be assembled.

In practice, this winch can be replaced by any device hoisting a load by means of a sling.

According to the embodiment, the sling 3 is provided with a first nonextensible part 3*a* above a section 3*c* provided with spring means 10, 10', enabling, under load, an elastic lengthening or shortening of the sling 3 by a certain limited amplitude in response to a certain limited change in the load on the piece 1. The sling in the example shown is furthermore provided with a second nonextensible part 3*b* beneath the section 3*c*.

The spring means 10, 10' are part of a load compensating device 4, which modifies the distance of the piece from the winch 2 to which the sling 3 is connected, in response to a force F1, F2 applied to the piece along the vertical axis A1 of the sling 3.

It will be noted that, in absence of the compensating device, the force F1 is equal to the stresses acting on the sling in its part connected to the winch and to the support structure, these stresses, being uncontrollable by nature, possibly exceeding the capacities of the sling, and the force F2 is equal to the weight of the piece being assembled.

The compensating device is primarily comprised of a frame 5, a floating support 6, and said spring means 10, 10'.

The spring means maintain the floating support 6 in a position of equilibrium, preferably a position for which the floating support 6 is centered vertically with respect to the frame 5 under the weight of the piece 1 in the absence of application of stress to the piece along the vertical axis A1.

Figure 2B:
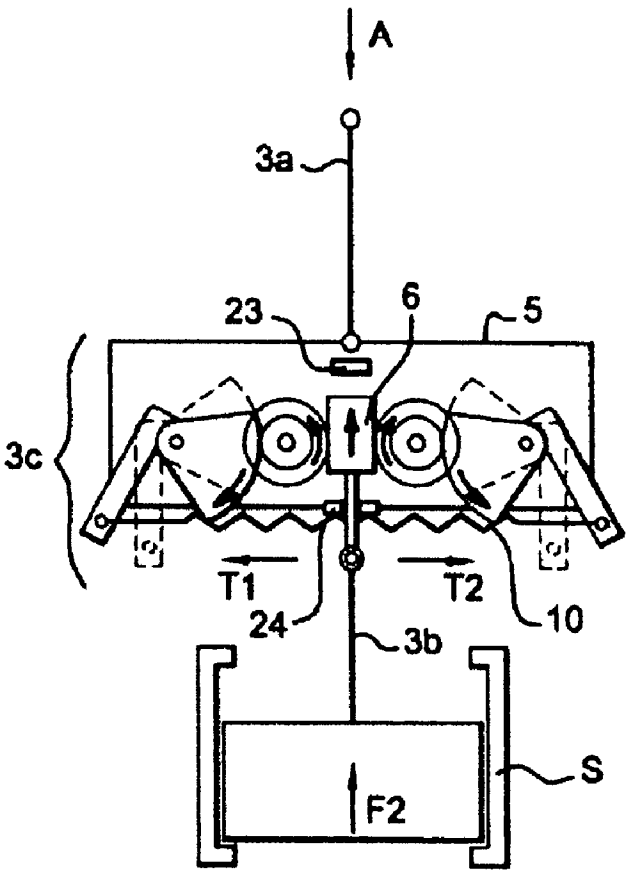
FIGS. 2A and 2B: schematic front views of the device according to the embodiment, respectively, under load in traction and without load in support.
Figure 2A:
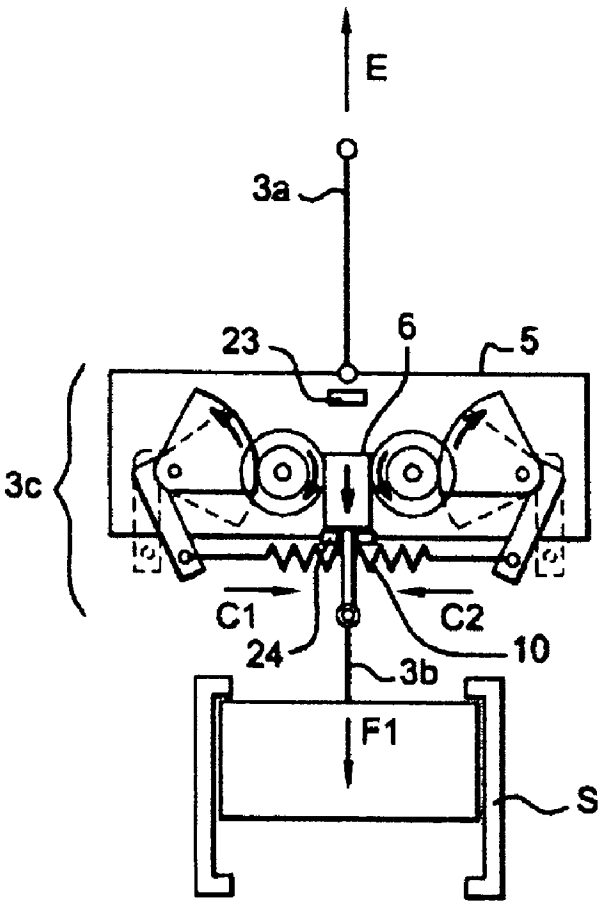
Figure 5:
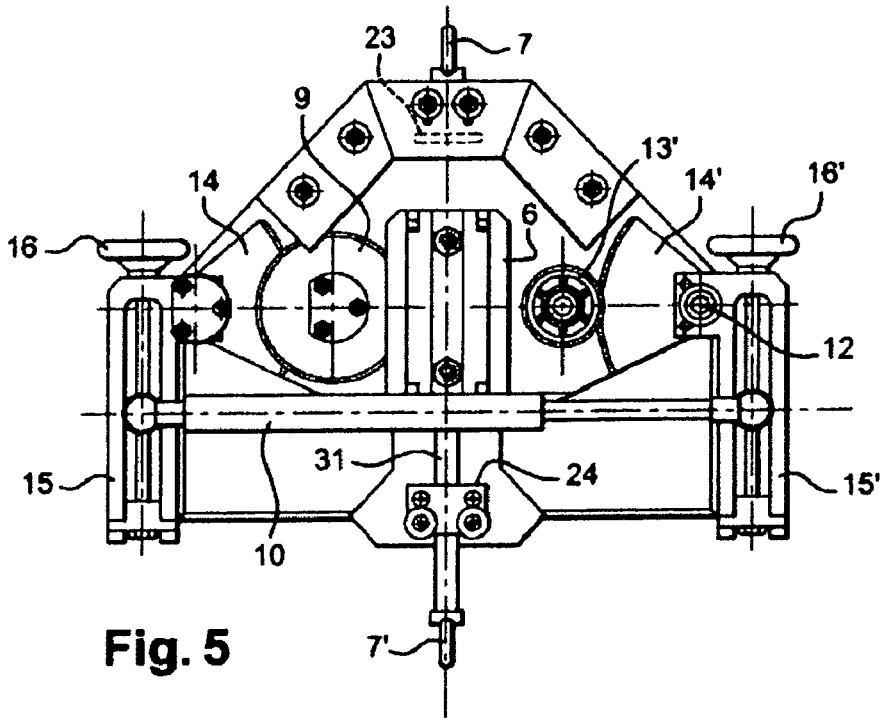
FIG. 5: the device of FIG. 3 in side view.

A schematic example of the operation of the device preferred according to the disclosed embodiments is described in FIGS. 2*a* and 2*b*.

As previously mentioned, the purpose of this embodiment is to limit the stresses on the piece and on the structure on the ground in event of a vertical displacement of the winch, caused by a bending of the support structure upward or downward.

The frame 5, the floating support 6 and the spring means 10 constitute a system deformable at equilibrium under the action of the weight of the piece. At equilibrium, the system is advantageously regulated so that the floating support is centered vertically with respect to the frame 5.

In FIG. 2*a*, the support structure experiences an elevation E, which pulls the winch upward.

The piece is lifted and abuts against an element of the structure on the ground S. As the piece is halted by the structure S, a force F1 is transmitted to the compensating device 4 via the floating support, which is pulled downward. Under this force, the sprint 10 experiences (being a compression spring in the proposed sample embodiment) a compression force C1, C2 and is compressed, thus allowing the floating support 6 to descend with respect to the frame 5, which limits the force applied by the piece to the structure.

According to FIG. 2*b*, the support structure experiences a subsidence A.

When the piece reaches a bottom abutment, the structure S applies to the piece an opposite reaction force F2, the traction on the mobile support diminishes, which slackens the spring 10 and causes the mobile support 6 to rise again, thus reducing or limiting the bearing force of the piece on the structure.

Figure 6:
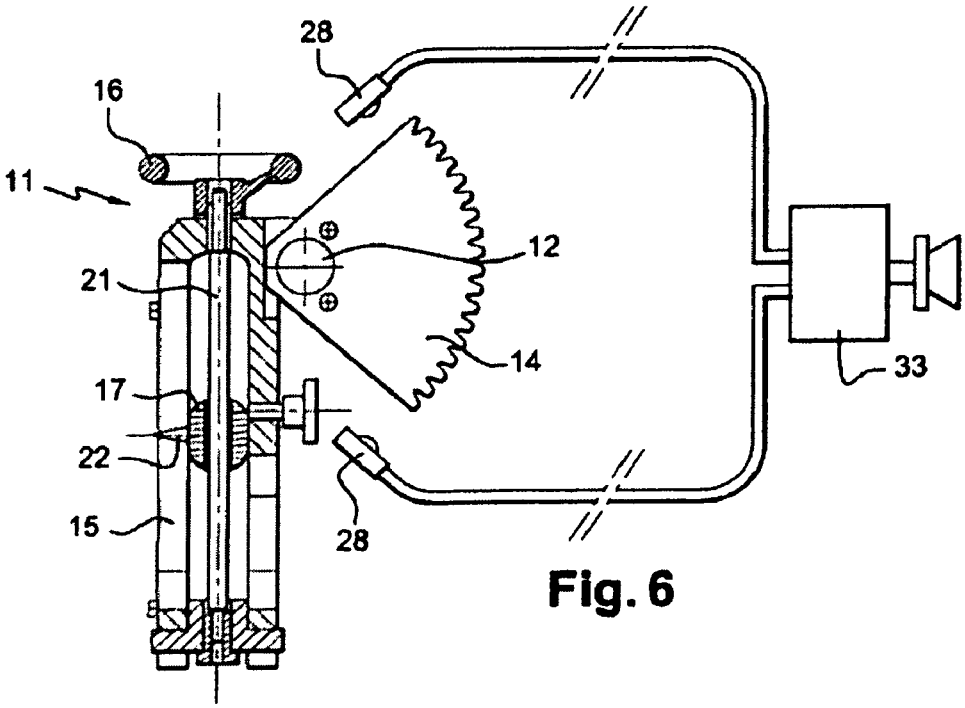
FIG. 6: a side sectional view of a rocking lever of the compensating device of FIG. 2.

As shall be seen afterwards, especially in reference to FIG. 6, the slinging device has means 16, 16' of regulating the amplitude of the lengthening or shortening of the sling 3 as a function of the lengthening and shortening of the spring means 10, so as to be able to regulate the midpoint of the floating support 6 as a function of the weight of the piece 1 being carried.

One example of the device is shown in further detail in FIG. 3.

The frame 5 contains a body provided with front surfaces, of which only portions 20*a*, 20*b*, 20*c*, 20*d* are shown at the region of axes of elements of the device, and a rear surface 19. The floating support 6 is mounted in the interior space defined by the front and rear surfaces.

According to the disclosed embodiments, either the frame 5 or the floating support 6 is provided with an upper end 7 for connection to a nonextensible part 3*a* of the sling 3, the other one being provided with a lower end outfitted with means 7' for holding the suspended piece.

In the example shown, it is the frame 5 which is connected to the upper nonextensible part 3*a* of the sling by its upper end 7, the floating support 6 being outfitted with means 7' for holding the suspended piece.

To allow for the extension or retraction of the sling, the floating support 6 is mounted able to slide in the frame 5 along the vertical axis A1 between guiding means 8, 8', 9, 9'.

The guiding means 8, 8', 9, 9' comprise at least one vertical rack 8, 8' integrated with the floating support 6 and meshing with a first pinion 9, 9', out of line with the floating support 6 on an axis perpendicular to said vertical axis A1.

According to the example and especially FIG. 3, the device is double and symmetrical with respect to a plane passing through the axis A1 and perpendicular to the rear surface 19 of the frame, the guide means 8, 8', 9, 9' being symmetrical with respect to said vertical axis A1, on either side of the floating support 6. A configuration of the device for which the floating support 6 comprises a single vertical rack and is able to slide at the side opposite the rack on a vertical rail is, of course, possible according to the disclosed embodiments.

Thus, the guiding means comprise at least one rack 8 and a pinion 9, engaging with the rack 8 and having an axis of rotation 25 integrated with the frame 5, perpendicular to said vertical axis A1 and to the front and rear surfaces of the frame, to enable a vertical displacement of the floating support in the frame.

According to the example, the spring means 10, 10' for their part are integrated in an arm 15 of a rocking lever 11, mounted on a shaft 12 integrated with the frame 5 and parallel to the axis of rotation 25 of the pinion 9, 9'.

To adapt the device to a range of given forces, the spring means 10, 10' are connected to the floating support 6 via a gearing down device, comprising said first pinion 9, 9', gearing means 13, 13', 14, 14', driving the rocking arm 11, 11' in rotation on a given angular sector.

In one sample application, the device is regulated to limit the force between the piece 1 and the structure on the ground to a value of 2% of the nominal load for a load between 2000 daN and 5000 daN, and it uses gas springs of known technology as the spring means 10.

It is possible to modify the operating range, in particular the value of the maximum strains when the device reaches mechanical abutment, by adapting the characteristics of the spring means used.

According to the example, there is provided a regulating of a position of equilibrium of the device.

The symmetrical device has two rocking levers driven to rotate in opposite direction about shafts 12, 12' integrated with the frame during vertical displacements of the floating support 6 with respect to the frame 5 and the spring means 10, 10' are suspended by their two ends between the arms of the rocking levers 11, 11'.

During vertical movements of the floating support under the action of a change in load at the region of the piece 1, the gearing down devices, being symmetrical with respect to the vertical axis A1 and comprising the first pinions 9 and 9' and gearing means 13, 13', 14, 14', drive the rocking arms 11, 11' in rotation of opposite direction on a given angular sector.

Thus, the applying of a load F1, F2 to the piece causes a displacement of the floating support 6, driving the arms 15, 15' in rotation in opposite direction until a new position of equilibrium is obtained for the floating support 6 under the action of the spring means 10, 10', which are constrained in compression or in extension depending on the direction of the load F1, F2 applied to the piece.

To enable a lever arm effect, the rocking levers 11, 11' are joined to the frame on the shaft 12 in the region of a first end of the arms 15, 15' and each of them is integrated at this end with a gearing element 14, 14', driven by one of the symmetrical gearing down devices and oriented perpendicular to the arms.

A view of a rocking lever is shown in FIG. 4, this figure representing the elements of the gearing down device comprising the racks 8, 8' on the floating support 6, one of the pinions 9, 9' meshing with the racks, this pinion 9 being coaxial with a gear rim 13 actuating the gearing element 14 of the rocking lever 11.

To receive the ends of the spring means 10, 10', the arms 15, 15' each receive a movable support 17, 17', supporting the spring means 10, 10', and they are provided with regulating means 16, 16' in the form of an endless screw 21, operated by a handwheel 16, 16', receiving the movable support 17, 17'.

These regulating means make it possible to equilibrate the device depending on the weight of the piece 1 to give the arms an amplitude of travel which is similar in the two directions (clockwise and counterclockwise).

Although this is not indispensable to the functioning of the device, it is advantageous to provide by design that the two arms 15, 15' are parallel when no load is applied to the hook 7'.

This arrangement means that the spring means 10, 10' do not have to be compressed during the regulation of the position of the movable supports 17, 17', which makes possible a regulation with no particular force on the means 16 and 16'.

According to a preferred regulation, the movable supports 17 and 17' have identical positions on the arms 15 and 15', respectively.

Figure 7A:
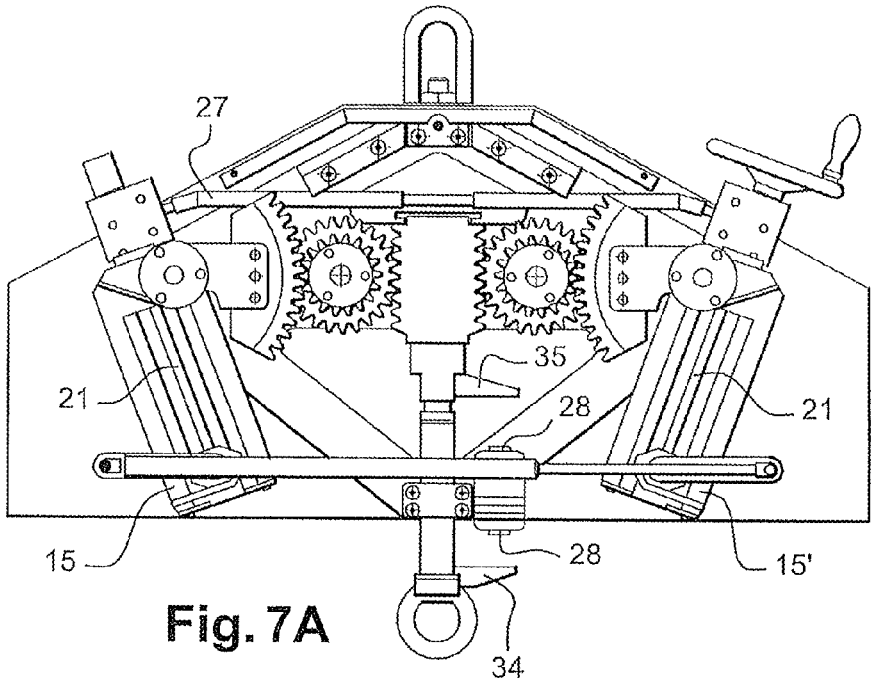
FIGS. 7A, 7B, and 7C: side views of details of embodiment of a device according to the disclosed embodiments.

FIG. 7A describes driving means 27 connecting the endless screws 21 of the arms 15 and 15' and allowing a simultaneous regulation of the position of the movable supports 17 and 17' while guaranteeing an identical positioning of these supports in the arms 15 and 15'.

Such driving means, which according to the example are realized by shafts and universal joints, can be realized according to the invention by chains or flexible shafts, such a modification being within the framework of general knowledge of the practitioner.

An action on the handwheels 16, 16' makes it possible to move the movable support 17, 17' along the arm 15 and thus bring closer or further away the point of application of the force exerted by the spring means 10, 10' of the articulation end of the arms.

Advantageously, the device is realized so that, for the position of equilibrium under load, the floating support 6 has a latitude of upward travel equal to its amplitude of downward travel between an upper end stop 23 and a lower end stop 24.

In the previously mentioned application, the end stops are reached at the fixed maximum amplitudes of travel, for example, at ±5 cm about the equilibrium value to take into account extreme permissible cases of bending of the support structure.

Thus, for any bending of the support structure of lesser amplitude, the force applied by the piece 1 to the structure or any element interposed between the piece and the structure remains less than the value defined above, or a load less than 100 daN.

To enable an easy regulating of the point of equilibrium depending on the weight of the pieces 1 being supported, pointers 22 integrated with each movable support 17, 17' travel opposite gradations 26 on the arms 15, 15'.

Finally, to prevent oscillations of the pieces during the maneuvering of the traveling crane or the winch, the device according to the invention calls for the spring means 10, 10' being placed in parallel with shock absorbing means 18, 18'.

In a supplemental embodiment, means of measurement and/or detection 28, 29, 30 of position of the device are realized.

In the case of means of detection of position, one or more end of travel sensors 28 make possible a detection of extreme position if the force reaches a particular limit.

A device with end of travel sensors 28 connected to an alarm device 33 is shown in FIG. 6.

The end of travel sensors 28 can be contact, inductive, or another kind.

FIG. 7A shows in particular an embodiment whereby end of travel sensors 28 are placed opposite abutment elements 34, 35 on the movable part of the device.

In the case when the sensor chosen is a measurement sensor 29 yielding a measurement of the position of the movable part of the device, a potentiometric sensor or an optical encoder can be used, without this list being exhaustive. An example of the placement of a potentiometric sensor is shown in FIG. 7C at the end of a holding axis of a gearing element 14.

The sensors are advantageously connected to devices such as devices for alarm and/or tracking of the process of compensation, these latter making it possible to alert the operators in advance when a change in the amplitude of the compensation movements during an assembly operation translates into a worsening of the safety conditions.

The detection of a detrimental change in the amplitude of the movements before reaching the physical abutments of the device makes it possible to interrupt the assembly operations until a return to safe working conditions.

In this case, the detection sensor(s) are measurement sensors 29 putting out a signal representative of the position in real time of the movable element of the device, connected to an alarm system comprising means of measurement and tracking of the change in the amplitude of the compensation movements, containing means of detecting the crossing of a threshold and the generating of an alarm when said threshold is crossed.

In the case when the sensor(s) are end of travel sensors 28, the alarm system to which they are connected can contain only a simple detection that the abutment has been reached or is close to being reached, triggering an alarm upon this detection.

Figure 7B:
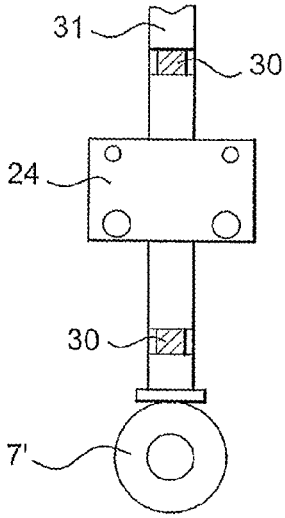
Figure 7C:
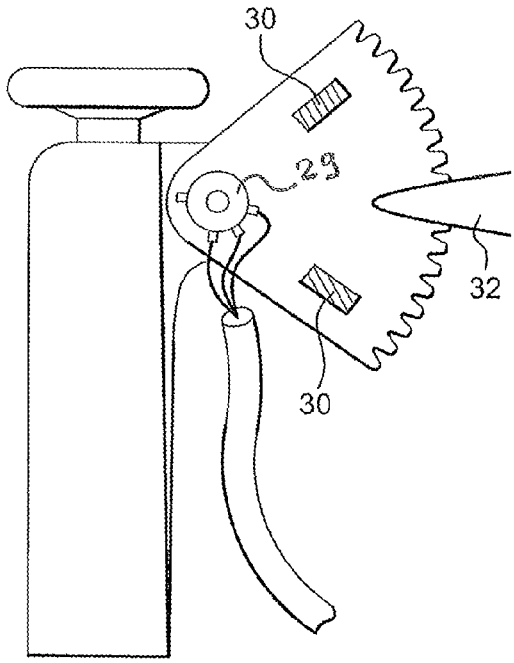

According to a simplified version, the means of detection are constituted by reference points, such as visual indicators 30 on at least one of the pieces in relative movement, as shown in FIGS. 7B, 7C.

For example, the rod 31 connected to the hook 7' which slides in the guide 24 can have color indicators on its upper and lower parts, which will appear and disappear beneath the guide 24 before the device reaches a mechanical abutment.

Advantageously, these indicators 30 are arranged on a flat surface set back on the cylindrical rod to avoid any risk of being effaced by wear during the sliding of the rod in the guide.

In equivalent manner, visual indicators 30 such as those shown in FIG. 7C opposite an index 32 on the pinions or the arms are possible according to the disclosed embodiments.

The disclosed embodiments further include a hoisting system such as a crane or a travelling crane comprising a sling made up of two parts 3*a* and 3*b*, between which is arranged a device according [to the invention].

The disclosed embodiments are not limited by the example shown and in particular a nonsymmetrical device for which one end of the spring means is integrated with the frame is possible according to the disclosed embodiments. Moreover, depending on the characteristics sought for the amplitude of travel of the hook and the allowable forces, it is possible to adapt the dimensions and the number of stages of pinions joining the movement of the arms 15, 15' to that of the floating support 6.

The invention claimed is:

1. A slinging device for a piece, comprising a sling provided with a nonextensible part and a section equipped with spring means, enabling an elastic lengthening or shortening of the sling under load by a certain limited amplitude in response to a particular limited change in the load on the piece, said device further comprising a frame, a floating support, said spring means holding the floating support, in the absence of application of force to the piece along the vertical axis, in a position of equilibrium centered vertically with respect to the frame under the weight of the piece, and means for regulating and adapting the position of equilibrium of the floating support depending on the weight of the piece, wherein the spring means are integrated with an arm of a rocking lever, mounted on a shaft integrated with the frame and perpendicular to said vertical axis and connected to the floating support via a gearing down device.

2. The device according to claim 1, further comprising a frame and a floating support, the spring means holding the floating support and being part of a load compensating means, modifying the distance between the piece and a winch to which the sling is connected in response to a force applied to the piece along the vertical axis of the sling.

3. The device according to claim 1, wherein either the frame or the floating support is provided with an upper end for connection to a nonextensible part of the sling, the other one being provided with a lower end outfitted with means for holding the suspended piece, the floating support being mounted able to slide in the frame along the vertical axis between guiding means.

4. The device according to claim 3, wherein the guiding means comprise at least one vertical rack integrated with the floating support and meshing with a first pinion, out of line with the floating support on an axis perpendicular to said vertical axis.

5. The device according to claim 3, wherein the gearing down device comprises said first pinion and comprises gearing means, driving the rocking arm in rotation on a given angular sector.

6. The device according to claim 3, wherein the guiding means are symmetrical with respect to said vertical axis, on either side of the floating support.

7. The device according to claim 6, wherein the spring means are suspended by their two ends between the arms of the rocking levers, and gearing down devices, symmetrical with respect to the vertical axis, join the rocking levers to the guiding means so that the applying of a load to the piece causes a displacement of the floating support, driving the arms in rotation in opposite direction until a new position of equilibrium is obtained for the floating support.

8. The device according to claim 7, wherein the rocking levers are joined to the frame in the region of a first end of the arms and each of them is integrated at this end with a gearing element, driven by one of the symmetrical gearing down devices and oriented perpendicular to the arms.

9. The device according to claim 7, wherein the arms each comprise a movable support, receiving the spring means, and regulating means to displace the movable support and bring closer or move further away the point of application of the force exerted by the spring means of the articulation end of the arms.

10. The device according to claim 9, wherein the floating support is centered vertically relative to the frame under the weight of the piece in absence of application of force to the piece along the vertical axis A1.

11. The device according to claim 1, wherein the spring means are placed in parallel with shock absorbing means.

12. The device according to claim 1, wherein it contains means of detection adapted to detect a particular position.

13. The device according to claim 12, wherein the means of detection comprise at least one visual indicator.

14. The device according to claim 12, wherein the means of detection comprise at least one position sensor.

15. The device according to claim 14, wherein the position sensor is an end of travel sensor.

16. The device according to claim 14, wherein the position sensor is a sensor putting out a signal representative of the position in real time of the movable element of the device.

17. The device according to claim 14, wherein the at least one position sensor is connected to an alarm system.

18. The device according to claim 17, wherein the alarm system comprises means of measurement and tracking of the change in the amplitude of the compensation movements, containing means of detecting the crossing of a threshold and generating of an alarm when said threshold is crossed.

19. The device according to claim 1, wherein the spring means are formed by gas springs.

20. A hoisting system, comprising a sling provided with a slinging device according to claim 1.

* * * * *